United States Patent [19]

Szloboda

[11] 4,352,676

[45] Oct. 5, 1982

[54] APPARATUS FOR CONVERTING GARBAGE INTO A FUEL GAS

[76] Inventor: David T. Szloboda, 10591 Skagit Dr., Richmond, B. C., Canada, V7E 1Z9

[21] Appl. No.: 242,434

[22] Filed: Mar. 11, 1981

Related U.S. Application Data

[62] Division of Ser. No. 149,241, May 12, 1980, abandoned.

[30] Foreign Application Priority Data

May 8, 1980 [CA] Canada ..... 351505

[51] Int. Cl.[3] ..... C10J 3/68

[52] U.S. Cl. ..... 48/76; 48/67; 48/111; 55/256

[58] Field of Search ..... 48/76, 111, 77, 73, 48/63, 64, 207, 69, 67, 128; 55/256; 110/215, 216

[56] References Cited

U.S. PATENT DOCUMENTS

| | | | |
|---|---|---|---|
| Re. 15,320 | 3/1922 | McDonald | 48/209 |
| 927,418 | 7/1909 | Loomis et al. | 48/209 |
| 1,505,065 | 8/1924 | West | 48/204 |
| 1,536,696 | 5/1925 | Wallace | 201/27 |
| 1,855,034 | 4/1932 | Stryker | 48/73 |
| 1,865,341 | 6/1932 | Smith | [illegible] |
| 2,204,902 | 6/1940 | McDon[illegible] | |
| 2,622,972 | 12/1952 | Bailey . | |
| 3,746,521 | 7/1973 | Giddin[illegible] | |
| 3,881,885 | 5/197[illegible] | | |

FOREIGN PATENT DOCUMENTS

| | | | |
|---|---|---|---|
| 130901 | 2/1911 | Canada . | |
| 504179 | 7/1954 | Canada . | |
| 592924 | 2/1960 | Canada . | |
| 602139 | 7/1960 | Canada . | |
| 761237 | 6/1967 | Canada . | |
| 899161 | 5/1972 | Canada . | |
| 982411 | 1/1976 | Canada . | |
| 833051 | 10/1938 | France | 48/76 |
| 2290488 | 6/1976 | France . | |
| 252862 | 6/1926 | United Kingdom | 48/76 |
| 2003128 | 3/1979 | United Kingdom . | |

*Primary Examiner*—S. Leon Bashore, Jr.
*Assistant Examiner*—Michael Goldman
*Attorney, Agent, or Firm*—Fleit & Jacobson

[57] ABSTRACT

Garbage to be converted is fed into the upper end of a vertical chamber. A gas collection chamber is provided around the upper end of the chamber and a blower is used for lowering the pressure in this gas collection chamber. The lower pressure causes a draw within a combustion zone defined at the lower end of the garbage chamber. The draw promotes combustion of garbage in the combustion zone much in the same manner that the draw by a pipe smoker will promote combustion within the bowl of his pipe. The gas collected in the gas chamber is delivered through a water filled cleaner or filter. The gas discharged from the upper end of the filter is ready for use in a power device or a furnace, or [illegible] and compressed or even liquified, [illegible]iner, for easy mobility and later use.

Drawing Figure

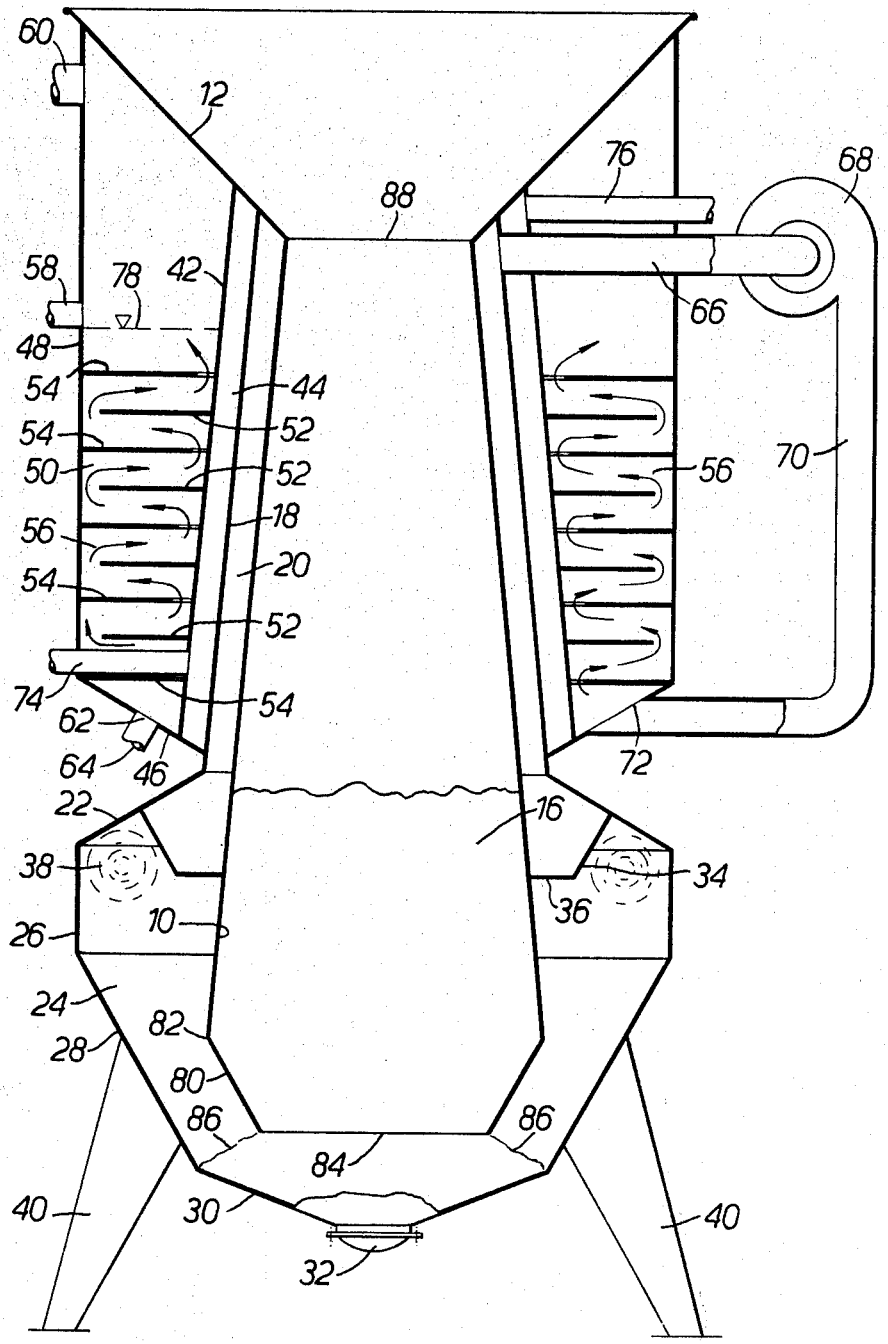
60
12
76
68
88
58
78
42
66
48
54
44
54
52
50
52
56
70
18
56
20
54
52
74
54
62
64
46
72
22
16
38
34
36
10
26
24
82
28
80
86
86
84
40
30
40
32

APPARATUS FOR CONVERTING GARBAGE INTO A FUEL GAS

This is a divisional of application Ser. No. 149,241 filed May 12, 1980, which is now abandoned.

FIELD OF THE INVENTION

This invention relates to a method and apparatus for converting essentially all types of garbage of an organic nature into a highly combustible gas, for use as a fuel.

SUMMARY OF THE INVENTION

Accordingly, this invention provides apparatus for converting garbage into combustible gas, which has a combustion chamber for the garbage having an inlet in an upper portion of the combustion chamber for introducing the garbage and an outlet in the lower portion of the combustion chamber. A gas chamber is positioned around the combustion chamber, which is in communication with the combustion chamber outlet and contains a baffle means which divides the gas chamber into upper and lower portions, and which acts, in the use of the apparatus, to cause solid products of combustion, in the gas leaving the outlet of the combustion chamber, to separate out from the gas so as to prevent a proportion of the solid products of combustion from entering the upper portion of the gas chamber. A gas chamber outlet is provided which is in communication with a suction line. A motor blower means is provided for sucking gas generated from the burning garbage through the garbage, the combustion chamber outlet, the gas chamber, the gas chamber outlet and the suction line creating a controlled suction through the garbage so that gaseous products of combustion in the combustion chamber are sucked through the burning solids in the combustion chamber and are converted into the combustion gas. A gas cooling chamber is positioned around the gas chamber and has inlet and outlet means for allowing cooling water to be circulated through the gas cooling chamber. A gas purifying chamber is provided to contain water and is positioned around the gas cooling chamber, which contains a baffle means for causing the gas, from a discharge line, which is introduced to the gas purifying chamber, to follow a zig-zag path through the gas purifying chamber. A gas outlet is provided in the gas purifying chamber for removing purified gas from the gas purifying chamber. The apparatus is such that the gas chamber does not have direct access to environmental air, so that the motor blower means can suck the gaseous products of combustion in the combustion chamber through the burning solids in the combustion chamber for the formation of the combustible gas.

Preferably, the apparatus is one in which the combustion chamber increases in diameter from its upper end to a point of maximum diameter near the combustion chamber outlet, and in which the combustion chamber decreases in diameter from its point of maximum diameter to the combustion chamber outlet.

The baffle means in the gas chamber may be constituted by an inwardly directed wall having an annular opening adjacent and around the combustion chamber.

The baffle means in the gas purifying chamber may comprise a first set of plates projecting from a first wall of the gas purifying chamber and a second set of plates projecting from a second and opposing wall of the gas purifying chamber, the first and the second sets of plates overlapping each other in spaced apart relationship.

It is believed that the present invention can be used for converting almost any type of garbage of an organic nature, be it domestic, industrial or agricultural, into a highly combustible fuel gas. The garbage materials usable in the invention include partially dried human or animal waste, vegetation material, food waste, and any combination of these substances.

BRIEF DESCRIPTION OF THE DRAWING

The drawing consists of one FIGURE in the nature of a vertical section view of a preferred apparatus embodiment of the invention.

Referring to the drawing, the illustrated embodiment of the apparatus of the invention comprises wall means 10 defining a vertically oriented central chamber 16 for receiving and holding the garbage. A frusto-conical wall 12 defines a loading funnel which is positioned at the upper end of the garbage holding chamber 16. As clearly shown by the drawing FIGURE, the chamber 16 increases in diameter from its upper and down to a location 82 closely adjacent its lower end. This is done so that the garbage will freely fall as it is introduced into the chamber 16. An annular wall 18 surrounds the upper portion of wall 10, in a spaced relationship thereto, so that an annular gas chamber 20 is defined between the upper portion of wall 10 and the wall 18. This annular chamber 20 is closed at its upper end by a lower end portion of wall 12. The lower end of wall 18 is connected to a frusto-conical upper portion wall 22 of a chamber 24 which is defined partially below and partially around the lower portion of the chamber 16.

The lower end of wall 22 is connected to the upper end of a cylindrical wall 26. The lower end of cylindrical wall 26 is connected to the upper end of another frusto-conical wall 28 which decreases in diameter as it extends downwardly. The lower end of wall 28 connects to the upper end of a frusto-conical bottom wall 30 which, as the drawing FIGURE clearly shows, tapers downwardly at a flatter angle.

Bottom 30 includes a central clean-out opening which is normally closed by a removable cover 32. A frusto-conical wall or baffle 34 is located in the upper portion of the chamber 24. Its upper or larger diameter end extends substantially normal to, and is connected with, an intermediate portion of wall 22. The lower or smaller diameter end of wall 34 helps define an annular opening 36 leading from an upper region of chamber 24 into passageway 20. The main purpose of wall 34 is to define an annular zone or nook 38 around the entrance opening 36 to the chamber 20 into which light particles of charcoal or ash can be trapped and held as will hereinafter be described in detail.

The apparatus may be supported by a plurality of legs 40 which are shown spaced about wall 28 and depending downwardly therefrom.

Another annular wall 42 is provided about wall 18 in a spaced relationship therefrom, to define with wall 18 an annular cooling compartment 44. This compartment 44 is closed at its upper end by a portion of the funnel wall 12 and is closed at its lower end by a portion of a frusto-conical wall 46.

An outer wall 48, which may be cylindrical in shape, surrounds wall 42 in a spaced relationship from it. The upper end of wall 48 is connected to an upper end portion of funnel wall 12. The lower end of wall 48 is connected to the upper end of frusto-conical wall 46. A relatively large volume chamber 50 is formed radially between walls 42 and 48, and axially between walls 12 and 46. The lower portion of this chamber 50 houses a plurality of radial baffles 52, 54. The baffles 52 are connected to inner wall 42 and project radially outwardly therefrom and terminate in a spaced relationship from wall 48. The radial baffles 54 are connected to outer wall 48 and project radially inwardly therefrom and terminate in a spaced relationship from wall 42. As illustrated, the baffles 52, 54 are vertically spaced apart from each other. This arrangement defines a tortuous or zigzag path through the chamber 50 as indicated by the arrows 56.

A first pipe 58 enters through wall 48 into a region of chamber 50 which is located closely above the upper most baffle 54. A second pipe 60 provides an outlet from chamber 50 and is located closely adjacent the upper end of the apparatus.

A clean-out opening 62 is provided in wall 46 from which extends a clean-out pipe 64 which is normally closed.

A suction line 66 extends from the upper end of chamber 20 to the suction side of a blower 68. A discharge pipe 70 extends from the discharge side of blower 68 to an inlet opening 72 leading into the lower end of chamber 50.

An inlet pipe 74 is provided for delivering cooling water into the lower end of the cooling water chamber 44. An outlet pipe 76 is provided at the upper end of chamber 44.

The apparatus is prepared for use in the following manner:

Firstly, water is introduced through pipe 58 until chamber 50 is full up to the level of pipe 58, as indicated by the water level line 78. Of course, at this time the clean-out opening 62 is closed, such as by maintaining a valve (not shown) in conduit 64 in a closed position. Cooling water is introduced into conduit 74 and allowed to flow out from conduit 76, so that the cooling water will be flowing through the cooling jacket 44 during operation of the apparatus.

Next, the gas producing procedure is initiated by the user placing a dry, easily ignitable type garbage, or other starter substance, e.g. wood chips, into the garbage container 16. This is done by simply dropping such substance into the open upper end of the funnel 12 until the garbage container 16 is about $\frac{1}{3}$ full.

As will be noted, the lower end of chamber 16 is restricted. This is easily done by reversing the direction of taper of the lower end portion of chamber wall 10, so that a frusto-conical section 80 which decreases in diameter will extend from the maximum diameter level 82 down to an outlet end 84 which is spaced vertically above the bottom wall 30. This lower end 84 is open. As a result, the garbage or other material introduced into chamber 16 will flow through opening 84 until the lower end of chamber 24 is full up to about the level of outlet 84. The material will continue to flow through opening 84 until it reaches its angle of repose at location 86, at which time it will cease to flow.

The starting substance is ignited, such as by the user igniting a piece of paper or the like and throwing it into the chamber 16, on top of the starting substance therein.

Prior to ignition the outlet pipe 60 is opened and the blower 68 is started, so that a suction will be created at the upper end of the reaction zone. This will cause the starting material to burn quite easily. The effect is very similar to that produced by a pipe smoker drawing or sucking on the stem of his pipe. The suction at the upper end of the reaction zone is caused by the blower 68 exerting a suction within chamber 20 which is felt at the inlet 36. This suction causes ambient air to be drawn into container 16 through the inlet opening 88. This air is drawn through the starting material, providing ample oxygen to support efficient combustion of such material.

A valve (not shown) may be provided in the outlet pipe 60 to be used for regulating the rate of flow of gases out from chamber 50. In so doing, it will indirectly regulate the fresh air supply to the reaction zone.

As stated above, combustion will take place in the lower portion of the chamber 16, and will be augmented by the airflow similar to the situation which exists when a cigarette or pipe smoker draws on his cigarette or pipe. The smoke, coal tar, wet steam and other products of combustion are sucked through the glowing charcoal portion of the burning solid matter. In the process, hydrogen is produced along with other combustible gases including carbon monoxide, carbon dioxide and some impurities. Light particles of charcoal or ash are carried by the flowing gases from the combustion zone up into the annular zone 38 which is defined radially outwardly from wall 34. The presence of wall 34 will cause a tore to form about it in which the ash material will be suspended. In this way, wall 34 will prevent the small particles from flowing upwardly into the compartment 20.

The gases which flow into compartment 20 are precooled by the cooling water which flows through compartment 44 and in the process gases are condensed to release coal tar mixed with wet steam. The condensate runs down the walls of chamber 20 into the lower region of chamber 24 and is ultimately recirculated. The gases are delivered out from the upper end of chamber 20, through conduit 66 and blower 68, then through conduit 70, and inlet 72, into the lower end of chamber 50. The energy of the blower forces such gases through the water contained within chamber 50. The tortuous path provided by the plates 52, 54 serves to delay the gases within chamber 50, so they will be better cleaned.

After the process has been started by use of the starting material, it is sustained by introducing wet garbage into the inlet opening 88.

The apparatus and operating procedure which have been described results in the production of a very clean, highly combustible, non-polluting gas. The gas is delivered ready for use out through the gas inlet pipe 60.

The garbage used in practicing the invention must be free from all nonorganic, noncombustible matter. This type of matter will not contribute to the combustion and would merely cause clogging in the apparatus. Also, small granular garbage is advantageously alternated with larger particles. That is, first a small quantity of one particle size garbage should be introduced into the inlet 88 and the other size, and then some more of the first size, etc. If the granular size of the material used is too small, it might restrict the flow of air through it enough to make combustion difficult.

The apparatus can be easily cleaned by merely flushing water through it, much as one would clean a hydrostatic filter in a furnace by running water through it.

The gas produced in accordance with this invention can be used as collected to operate internal combustion engines, turbine engines, furnaces, and also can be compressed into containers, or liquified for mobility.

It is believed that the apparatus will operate substantially pollution free with appropriate combustible material. The apparatus utilizes a continuous flow process, and may be used with any one of a large number of devices for feeding the garbage material into the funnel. The apparatus itself is self-contained and involves no moving parts other than the rotating fan of the blower. Also, it is believed that the device is explosion proof.

The apparatus can be made in almost any size and it is believed that all sizes will perform equally well, provided that the proportions of the chambers and passageways are selected such that the proper amount of air for supporting combustion will flow through the combustion zone and a sufficient amount of dwell time is allowed within the cleaning chamber 50 to assure that the produced gas is essentially pure.

What is claimed is:

1. Apparatus for converting garbage into combustible gas, which apparatus comprises:

a combustion chamber for the garbage;

a combustion chamber inlet in an upper portion of the combustion chamber for introducing the garbage into the combustion chamber;

a combustion chamber outlet in a lower portion of the combustion chamber;

a gas chamber which is positioned around the combustion chamber and which is in communication with the combustion chamber outlet;

baffle means which is in the gas chamber, which divides the gas chamber into upper and lower portions, and which acts in the use of the apparatus to cause solid products of combustion in the gas leaving the outlet of the combustion chamber to separate out from the gas and so prevent a proportion of the solid products of combustion from entering the upper portion of the gas chamber;

a gas chamber outlet;

a suction line which is in communication with the gas chamber outlet;

motor blower means for sucking gas generated from the burning garbage through the garbage, the combustion chamber outlet, the gas chamber, the gas chamber outlet, and the suction line, whereby the motor blower means creates a controlled suction through the garbage so that gaseous products of combustion in the combustion chamber are sucked through the burning solids in the combustion chamber and are converted into the combustible gas;

a gas cooling chamber which is positioned around the gas chamber and which has inlet and outlet means for allowing cooling water to be circulated through the gas cooling chamber;

a gas purifying chamber which is for containing water and which is positioned around the gas cooling chamber;

a discharge line for introducing gas from the motor blower means into an inlet of the gas purifying chamber, the motor blower means forcing the gas along the discharge line and through the gas purifying chamber;

baffle means in the gas purifying chamber for causing the gas from the discharge line which is introduced to the gas purifying chamber to follow a zig-zag path through the gas purifying chamber; and a gas outlet in the gas purifying chamber for removed purifying gas from the gas purifying chamber; the said apparatus being such that the gas chamber does not have direct access to environmental air so that the motor blower means can suck the gaseous products of combustion in the combustion chamber through the burning solids in the combustion chamber for the formation of the combustible gas.

2. Apparatus according to claim 1 in which the combustion chamber increases in diameter from its upper end to a point of maximum diameter near the combustion chamber outlet, and in which the combustion chamber decreases in diameter from its point of maximum diameter to the combustion chamber outlet.

3. Apparatus according to claim 1 or claim 2 in which the baffle means in the gas chamber is constituted by an inwardly directed wall having an annular opening adjacent and around the combustion chamber.

4. Apparatus according to claim 1 or claim 2 in which the baffle means in the gas purifying chamber comprises a first set of plates projecting from a first wall of the gas purifying chamber and a second sets of plates projecting from a second and opposing wall of the gas purifying chamber, the first and the second sets of plates overlapping each other in spaced apart relationship.

5. Apparatus according to claim 1, wherein the combustion chamber outlet is in a lowermost portion of the combustion chamber, and wherein a portion of the gas chamber is positioned below said combustion chamber outlet for receiving combustible material flowing out of said combustion chamber during initial filling of said combustion chamber with combustible material.

* * * * *